US007899369B2

(12) United States Patent
Kurogawa

(10) Patent No.: US 7,899,369 B2
(45) Date of Patent: Mar. 1, 2011

(54) POWDER CONVEYING DEVICE AND IMAGE FORMING APPARATUS HAVING THE SAME

(75) Inventor: Naonori Kurogawa, Suwon-Si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 321 days.

(21) Appl. No.: 12/166,662

(22) Filed: Jul. 2, 2008

(65) Prior Publication Data

US 2009/0060590 A1 Mar. 5, 2009

(30) Foreign Application Priority Data

Aug. 28, 2007 (KR) ..... 10-2007-0086370

(51) Int. Cl.
*G03G 15/08* (2006.01)

(52) U.S. Cl. ..... 399/258; 399/261; 399/265

(58) Field of Classification Search ..... 399/222, 399/258, 261, 265; 347/140; 222/DIG. 1
See application file for complete search history.

(56) References Cited

U.S. PATENT DOCUMENTS 3,973,517 A * 8/1976 Hudson ..... 399/292
7,076,192 B2 7/2006 Tsuda et al.

FOREIGN PATENT DOCUMENTS

JP 5-38093 2/1993
JP 2004-220012 8/2004
JP 2006-348214 12/2006
JP 2007-017464 1/2007
JP 2007-057790 3/2007

OTHER PUBLICATIONS

English language abstract of JP 2007-57790, published Mar. 8, 2007.
Machine English language translation of JP 2007-57790, published Mar. 8, 2007.
English language abstract of JP 2007-017464, published Jan. 25, 2007.
Machine English language translation of JP 2007-017464, published Jan. 25, 2007.
English language abstract of JP 5-038093, published Feb. 12, 1993.
Machine English language translation of JP 5-038093, published Feb. 12, 1993.

(Continued)

*Primary Examiner*—David M Gray
*Assistant Examiner*—Barnabas T Fekete
(74) *Attorney, Agent, or Firm*—Stanzione & Kim, LLP

(57) ABSTRACT

A powder conveying device and an image forming apparatus having the same are disclosed. The powder conveying device to convey powder such as toner, includes a conveying plate to carry powder thereon, a vibration generating device to vibrate the conveying plate, and a plurality of conveying protrusions provided on a surface of the conveying plate to convey the powder loaded on the conveying plate. Each of the conveying protrusions has an incline of an upstream side and an incline of a downstream side on a powder conveying path. The incline of the upstream side is smaller than the incline of the downstream side. The powder conveying device can realized with smaller size and/or with lower cost.

22 Claims, 10 Drawing Sheets

OTHER PUBLICATIONS

English language abstract of JP 2006-348214, published Dec. 28, 2006.
Machine English language translation of JP 2006-348214, published Dec. 28, 2006.
English language abstract of JP 2004-220012, published Aug. 5, 2004.
Machine English language translation of JP 2004-220012, published Aug. 5, 2004.

* cited by examiner

POWDER CONVEYING DEVICE AND IMAGE FORMING APPARATUS HAVING THE SAME

CROSS-REFERENCE TO RELATED APPLICATION

This application claims the benefit of Korean Patent Application No. 2007-0086370, filed on Aug. 28, 2007 in the Korean Intellectual Property Office, the disclosure of which is incorporated herein by reference.

BACKGROUND OF THE INVENTION

1. Field of the Invention

The present invention relates to a powder conveying device, and more particularly to a powder conveying device and an image forming apparatus having the same.

2. Description of the Related Art

A powder conveying device is used to convey powder composed of fine particles such as, for example, toner particles. Generally, a powder conveying device may be used in manufacturing equipments for various products to convey powder type row material, or in a device that uses powder material in operation to convey a predetermined amount of powder.

An example of a powder conveying device is described in U.S. Pat. No. 7,076,192 to Tsuda et al. ("Tsuda"), which discloses a powder conveying device employed in an electrophotographic image forming apparatus to convey toner. The powder conveying device disclosed by Tsuda includes a coil spring (a rotary type feeding member) placed inside a conveying pipe and a driving device to rotate the coil spring. Toner in the conveying pipe is conveyed toward an outlet by the rotation of the coil spring.

The coil spring type powder conveying device, e.g., disclosed by Tsuda, may, unfortunately, cause unpleasant noise from the coil spring contacting against the inner surface of the curved conveying pipe while rotating inside, and being elastically deformed by the curved shape of, the conveying pipe. Further, a significantly large space may be required for forming the curved conveying path of the toner, which increases the overall size of the image forming apparatus.

Another type of powder conveying device may utilize an auger having a helical-shaped blade, by the rotation of which the toner particles may be conveyed in a conveying path. Examples of the auger type powder conveying devices are described in, e.g., Japanese Patent Laid-open Publication No. 2007-57790 to Yoshinori ("Yoshinori") and Japanese Patent Laid-open Publication No. 2007-17464 to Tomoyuki ("Tomoyuki").

These auger type powder conveying devices, e.g., of Yoshinori or Tomoyuki, because they require a motor to rotate the auger and a gear train to transmit the driving force, unfortunately, also tends to be expensive and to increase the overall size of the image forming apparatus.

SUMMARY OF THE INVENTION

Therefore, it is an aspect of the invention to provide a powder conveying device and an image forming apparatus having the same that contributes to smaller size and lower cost of the image forming apparatus.

Additional aspects and/or advantages of the invention will be set forth in part in the description which follows and, in part, will be obvious from the description, or may be learned by practice of the invention.

In accordance with an aspect of the invention, there is provided a powder conveying device to convey powder, comprising: a conveying plate having a surface on which the powder to be conveyed is supported; a vibration generating device configured to cause the conveying plate to vibrate; and a plurality of conveying protrusions provided on the surface of the conveying plate to promote a movement of the powder from an upstream end of the conveying plate to a downstream end of the conveying plate, each of the plurality of conveying protrusions having a first inclined surface facing the upstream end of the conveying plate and a second inclined surface facing the downstream end of the conveying plate, each first inclined surface of an associated one of the plurality of conveying protrusions having a smaller incline angle than the second inclined surface of the associated one of the plurality of conveying protrusions.

Each of the conveying protrusions may have a height that is less than or equal to ten times of a volume average diameter of particles of the powder.

Each of the conveying protrusions may have a height that is less than or equal to five times of the volume average diameter of particles of the powder.

Each of the conveying protrusions can be formed integrally with the conveying plate.

The vibration generating device may be mounted at the upstream end of the conveying plate.

The vibration generating device comprises a flat vibration brushless motor.

The first inclined surface of a conveying protrusion may form a first angle with respect to the surface of the conveying plate, the second inclined surface forming a second angle with respect to the surface of the conveying plate, the first angle being between 1° to 20°, and the second angle being between 20° to 150°.

The first angle may be between angle of 1° to 15°.

The powder conveying device may further comprise: a collision member disposed at a location within a range of motion of the conveying plate such that, when the conveying plate vibrates, the conveying plate collides with the collision member.

The collision member may be disposed near the downstream end of the conveying plate.

The conveying plate and the plurality of conveying protrusions may be coated with a coating layer to prevent the powder from adhering to surfaces of at least one of the conveying plate and the plurality of conveying protrusions.

The vibration generating device has a vibration intensity between 1 G to 11 and a number of revolution between 1,000 to 100,000 revolution per minute, where G is a unit of measuring the acceleration due to gravity at the Earth's surface, also known to those of ordinary skill in the art as "G-force".

In accordance with another aspect of the invention, there is provided an image forming apparatus comprising: a main body defining an exterior appearance of the image forming apparatus; and a toner conveying device disposed in the main body, the toner conveying device comprising: a conveying plate having a surface on which toner to be conveyed is supported; a vibration generating device configured to cause the conveying plate to vibrate; and a plurality of conveying protrusions provided on the surface of the conveying plate to promote a movement of the toner from an upstream end of the conveying plate to a downstream end of the conveying plate, each of the plurality of conveying protrusions having a first inclined surface facing the upstream end of the conveying plate and a second inclined surface facing the downstream end of the conveying plate, each first inclined surface of an associated one of the plurality of conveying protrusions having a smaller incline angle than the second inclined surface of the associated one of the plurality of conveying protrusions.

The image forming apparatus may further comprise: a developing unit disposed in the main body, the developing unit may include: a supply roller disposed adjacent to the downstream end of the conveying plate so as to receive toner from the toner conveying device; and a developing member disposed adjacent to the supply roller to receive the toner from the supply roller, the developing member being configured to apply the toner received from the supply roller to an electrostatic latent image formed on a photosensitive body.

BRIEF DESCRIPTION OF THE DRAWINGS

These and/or other aspects and advantages of the embodiments of the invention will become apparent and more readily appreciated from the following description of the embodiments, taken in conjunction with the accompanying drawings, of which.

DETAILED DESCRIPTION OF THE PREFERRED EMBODIMENTS

Figure 1:
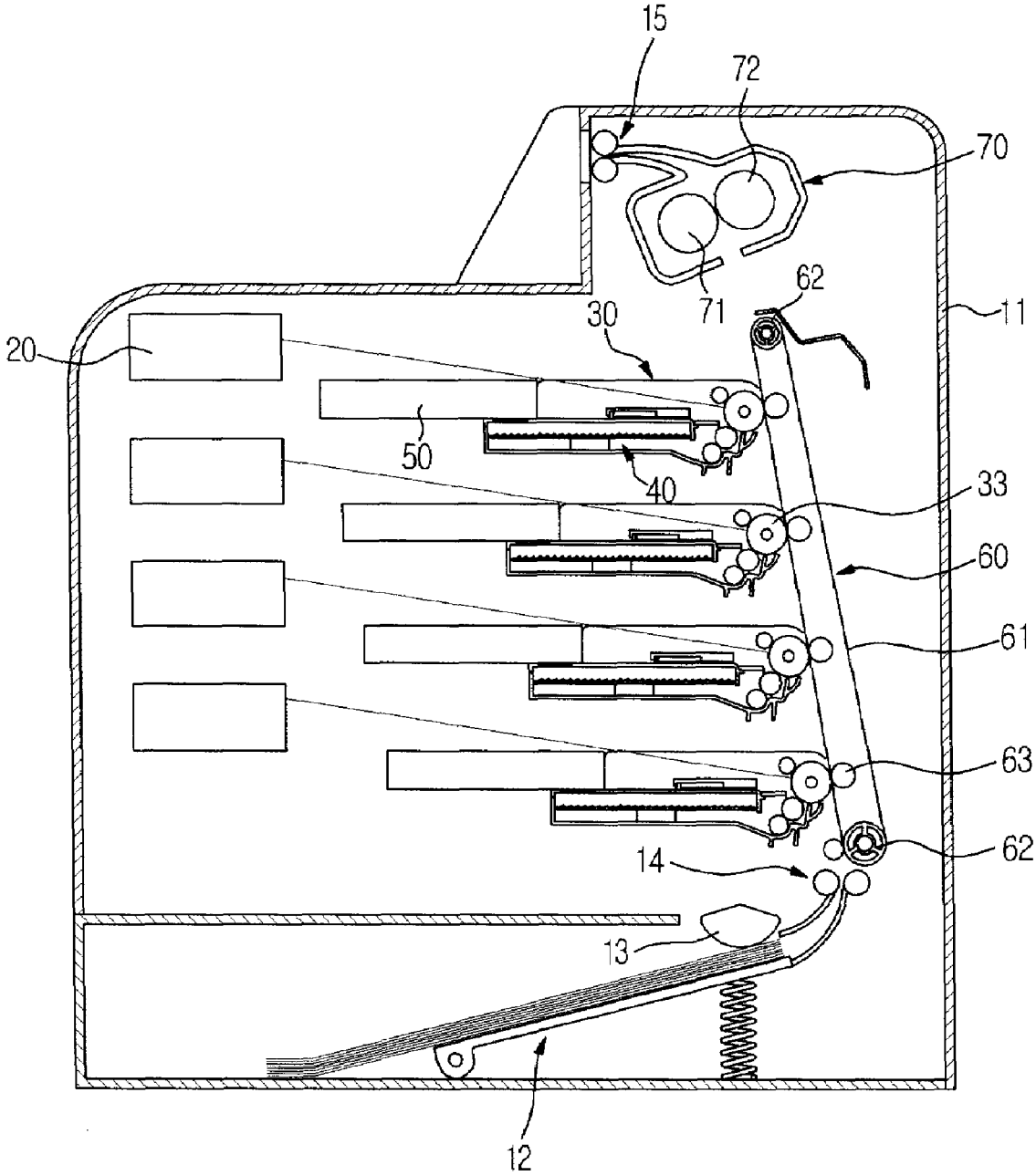
FIG. 1 is a side-sectional view schematically illustrating an image forming apparatus according to an embodiment of the present invention.

Reference will now be made in detail to exemplary embodiments of the present invention, examples of which are illustrated in the accompanying drawings, wherein like reference numerals refer to like elements throughout.

As shown in FIG. 1, an image forming apparatus according to this embodiment may be, e.g., an electrophotographic type color image forming apparatus, which includes a main body 11 that defines the exterior appearance of the image forming apparatus, developing units 30 of four colors (e.g., yellow, magenta, cyan and black) mounted in the main body 11, and powder conveying devices 40 mounted in the respective developing units 30 to convey toner.

According to this embodiment, inside the main body 11 are mounted four exposure units 20 to irradiate light to the respective developing units 30, a transfer unit 60 to transfer visible toner images formed on the respective developing units 30 onto a printing medium, and a fusing unit 70 to fuse the transferred visible images to the printing medium. In addition, inside the main body 11 are mounted a printing medium feeding device 12 to supply a printing medium, a pickup device 13 to pick up the printing medium loaded in the printing medium feeding device 12, a feeding roller 14 to feed the picked-up printing medium toward the developing units 30, and a discharge roller 15 to discharge the printing medium that has passed through the fusing unit 70 to the outside of the main body 11.

The transfer unit 60 may include a feeding belt 61 to feed the printing medium, plural belt driving rollers 62 to run the feeding belt 61, and plural transfer rollers 63 to transfer visible images formed on photosensitive bodies 33 provided in the developing units 30 onto the printing medium fed by the feeding belt 61. The fusing unit 70 may include a heating roller 71 to generate heat, and a press roller 72 provided to rotate while being in pressing contact with the heating roller 71.

Figure 2:
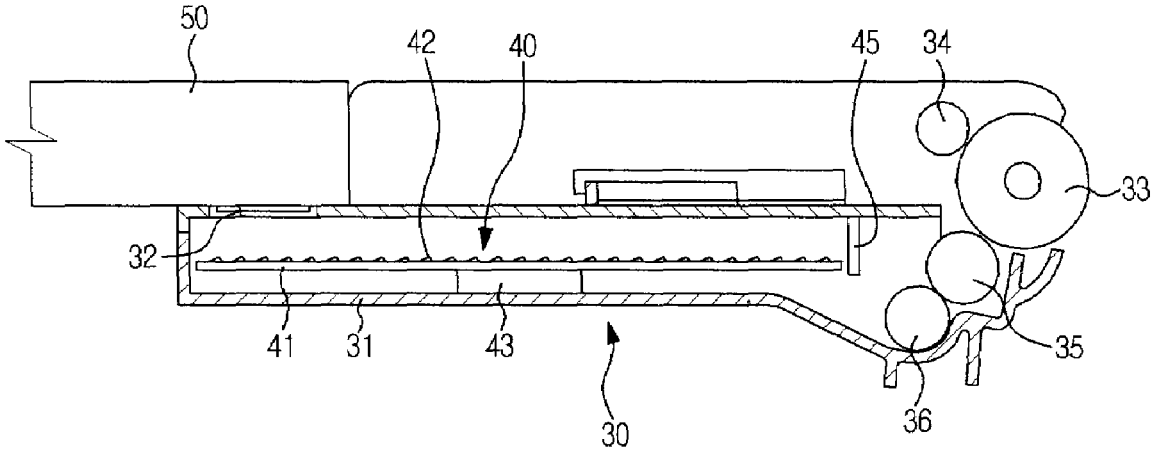
FIG. 2 is a side-sectional view schematically illustrating a developing unit of the image forming apparatus shown in FIG. 1.

As shown in FIG. 2, each of the developing units 30 includes a housing 31, a photosensitive body 33 mounted at an end portion of the housing 31 in such a way that a portion of the photosensitive body 33 is exposed to the outside, on which an electrostatic latent image is formed by receiving light from the exposure unit 20, a charge device 34 to charge the surface of the photosensitive body 33 to a predetermined electric potential, a developing member 35 to form a visible image by attaching toner to the photosensitive body 33 on which the electrostatic latent image has been formed, a supply roller 36 to supply toner to the developing member 35, and a powder conveying device 40 to convey toner to the supply roller 36.

The housing 31 is provided with a supply port 32 at an upper portion thereof, and a toner container 50 for supplying toner into the housing 31 is coupled to the upper portion of the housing 31. The toner in the toner container 50 is supplied into the housing 31 through the supply port 32. The powder conveying device 40 conveys the toner supplied through the supply port 32 near one end of the housing 31 towards the supply roller 36 mounted at the other end of the housing 31.

Figure 3:
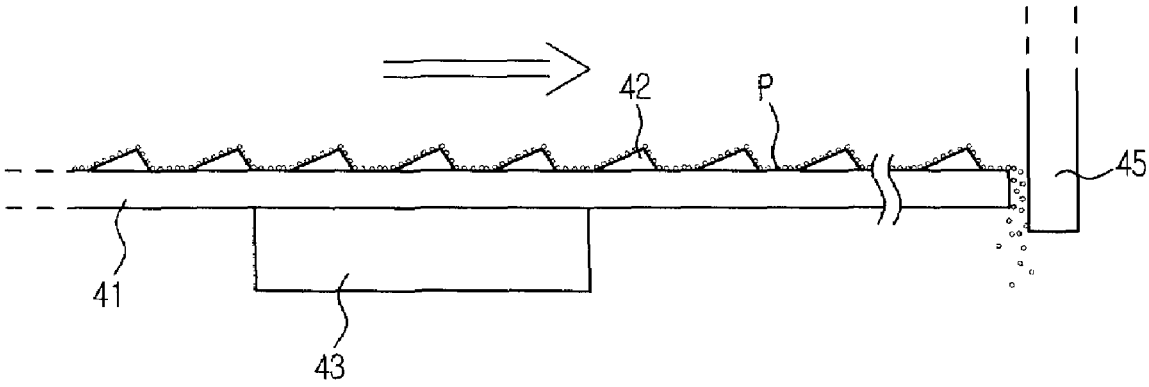
FIG. 3 is a side view schematically illustrating a powder conveying device of the developing unit shown in FIG. 2.

The powder conveying device 40 includes a conveying plate 41 on which toner particles are carried, a plurality of conveying protrusions 42 provided on the surface of the conveying plate 41, a vibration generating device 43 to vibrate the conveying plate 41, and a collision member 45 mounted spaced apart from the conveying plate 41 so as to collide with the conveying plate 41. As shown in FIG. 3, if the vibration generating device 43 operates to vibrate the conveying plate 41, the toner on the surface of the conveying plate 41 is applied with a propulsive force in horizontal and vertical directions, and is conveyed toward the supply roller 36 by the interaction with the conveying protrusions 42.

The conveying plate 41 and the conveying protrusions 42 may be made of the same material, or may be made of different materials from each other. The conveying plate 41 and the conveying protrusions 42 can be made of various materials, for example, a metallic material such as aluminum, stainless steel (SUS), brass or the like, or a resin material such as acrylic resin, silicone resin, polycarbonate resin or the like. The surfaces of the conveying plate 41 and the conveying protrusions 42 may be coated with a coating layer 44, which may be, e.g., silicone or Teflon, so as to prevent the toner from being adhered to the conveying plate 41 and/or the conveying protrusions 42.

Although the conveying plate 41 and the conveying protrusions 42 are not depicted in detail because the drawings show the shapes of the conveying plate 41 and the conveying protrusions 42 viewed from the side, the conveying plate 41 may be formed as a flat rectangular plate shape having a regular width. Each of the conveying protrusions 42 may have a length equal to the width of the conveying plate 41, and may have a triangular or a ramp cross-sectional shape. Preferably, the plurality of conveying protrusions 42 are arranged on the surface of the conveying plate 41 with a regular gap therebetween, the size of which gap may vary.

Figure 4:
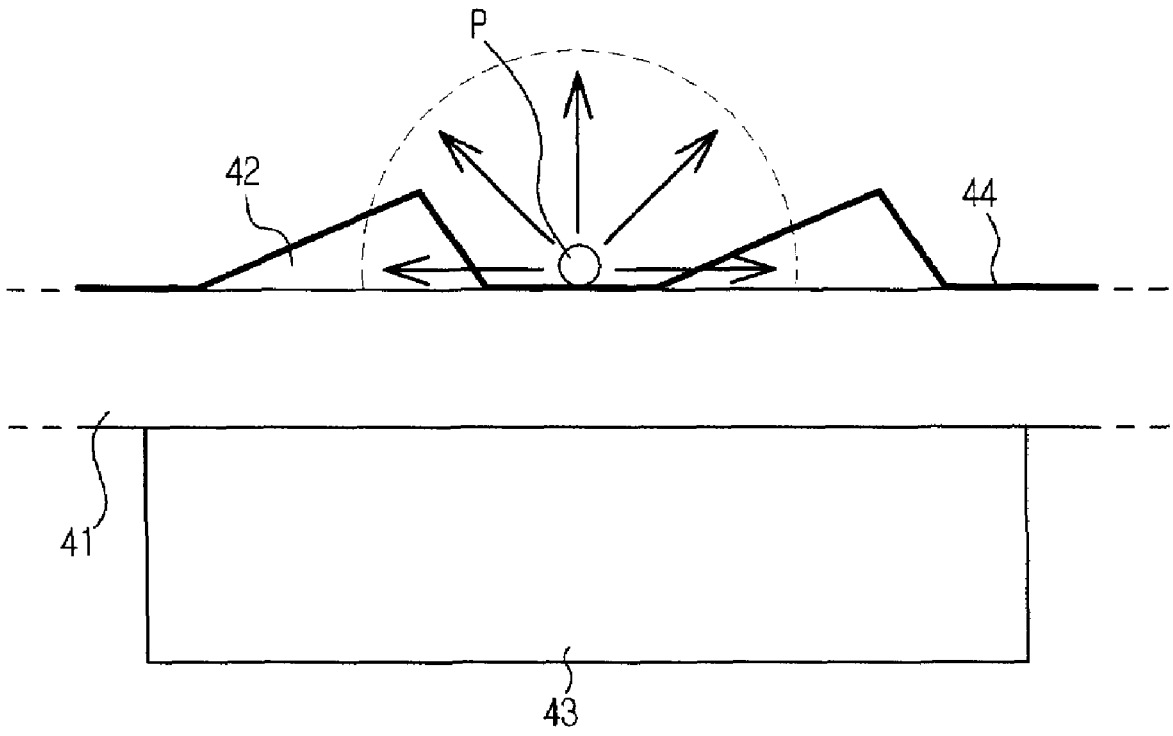
FIGS. 4 to 6 are side views illustrating a portion of the powder conveying device shown in FIG. 3.

As shown in FIG. 4, if the vibration generating device 43 operates to vibrate the conveying plate 41, particles P of the powder on the surface of the conveying plate 41 are applied with a propulsive force that is substantially isotropic in the horizontal and vertical directions. The particles P, to which such a propulsive force is applied, are conveyed to the right as shown in the drawing by the interaction with the plurality of conveying protrusions 42.

Figure 5:
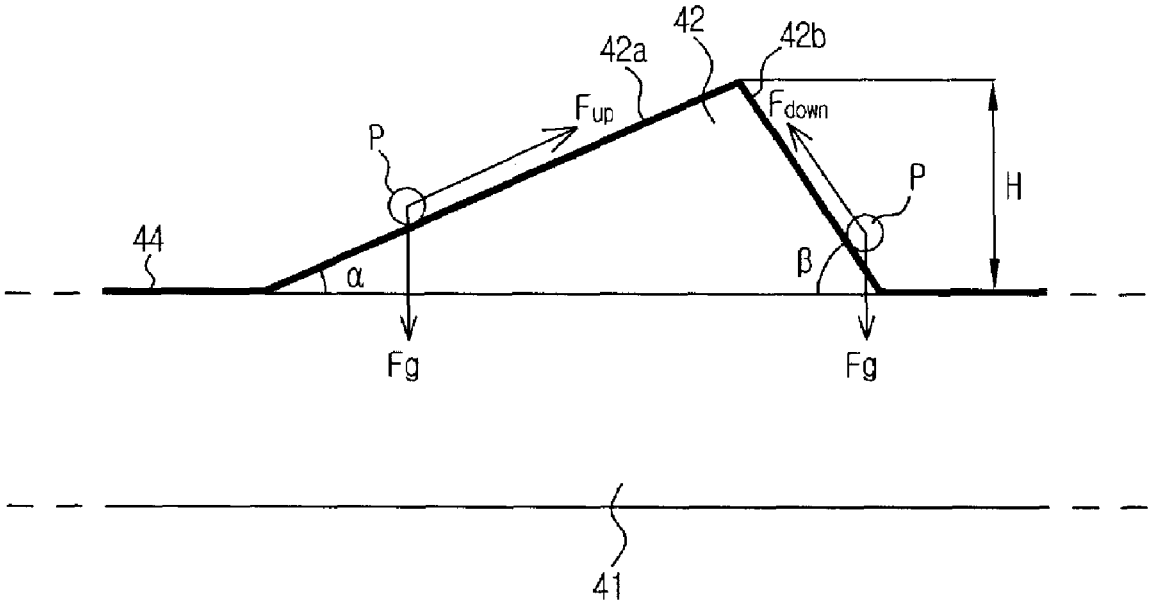

As shown in FIG. 5, it is preferred that each of the conveying protrusions 42 has a height H, which may be up to ten times the volume average diameter of the powder particles P. More preferably, the height H of each of the conveying protrusions 42 may be less than or equal to five times the volume average diameter of the powder particles P. The slope of the upstream ramp (with respect to the conveying direction of toner) of each of the conveying protrusions 42 is smaller than the slope of the downstream ramp. In other words, the upstream incline angle α formed between the upstream ramp surface 42*a* of the conveying protrusion 42 and the surface of the conveying plate 41 is smaller than the downstream angle β formed between the downstream ramp surface 42*b* of the conveying protrusion 42 and the surface of the conveying plate 41. Since the conveying protrusion 42 is shaped such that the upstream angle α is smaller than the downstream angle β, a force Fup required for the powder particle P on the upstream surface 42*a* to climb up the upstream ramp surface 42*a* against the gravity Fg is smaller than the force Fdown required for the powder particle P on the downstream surface 42*b* to climb up the downstream ramp surface 42*b* against the gravity Fg. Accordingly, when the propulsive force is applied to the powder by the vibration generating device 43, the amount of powder moving in the downstream direction is larger than the amount of powder moving in the upstream direction. As a result, the powder is conveyed in the downstream direction.

The upstream angle α of the conveying protrusion 42 is preferably in the range of 1° to 20°, more preferably 1° to 15°. When the upstream angle α is larger than 15°, the performance of conveying the powder in the downstream direction may deteriorate. The downstream angle β is preferably in the range of 20° to 150°. If the downstream angle β is set beyond this range, the conveyance of the powder may become difficult.

The vibration generating device 43 is mounted under the conveying plate 41 to vibrate the conveying plate 41. Various devices capable of vibrating the conveying plate 41, for example, a piezoelectric element, a vibration motor having an eccentric rotating body, a flat vibration brushless motor, etc., can be used as the vibration generating device 43. A vibration intensity of the vibration generating device 43 varies depending on the type of the powder. For example, when the powder of polyester resin with a volume average diameter of 8.0 μm is intended to be conveyed, it is preferable to use the vibration generating device 43 having a vibration intensity of between 1 G to 11 G.

Taking the size and cost into consideration, it is preferable to use a flat vibration brushless motor (for example, a flat vibration brushless motor disclosed in Japanese Patent Laid-open Publication No. Hei 5-38093 (published on Feb. 12, 1993 to Makoto), the disclosure of which is incorporated herein by reference) as the vibration generating device 43. While the scope of the present invention is not so limited, it may be preferred that the motor has a number of revolutions of between 1,000 to 100,000 revolutions per minute (rpm). A number of revolutions smaller than 1,000 rpm may not provide a sufficient conveyance of the toner particles. If the number of revolutions is larger than 100,000 rpm, the cost of the motor may be high.

Figure 6:
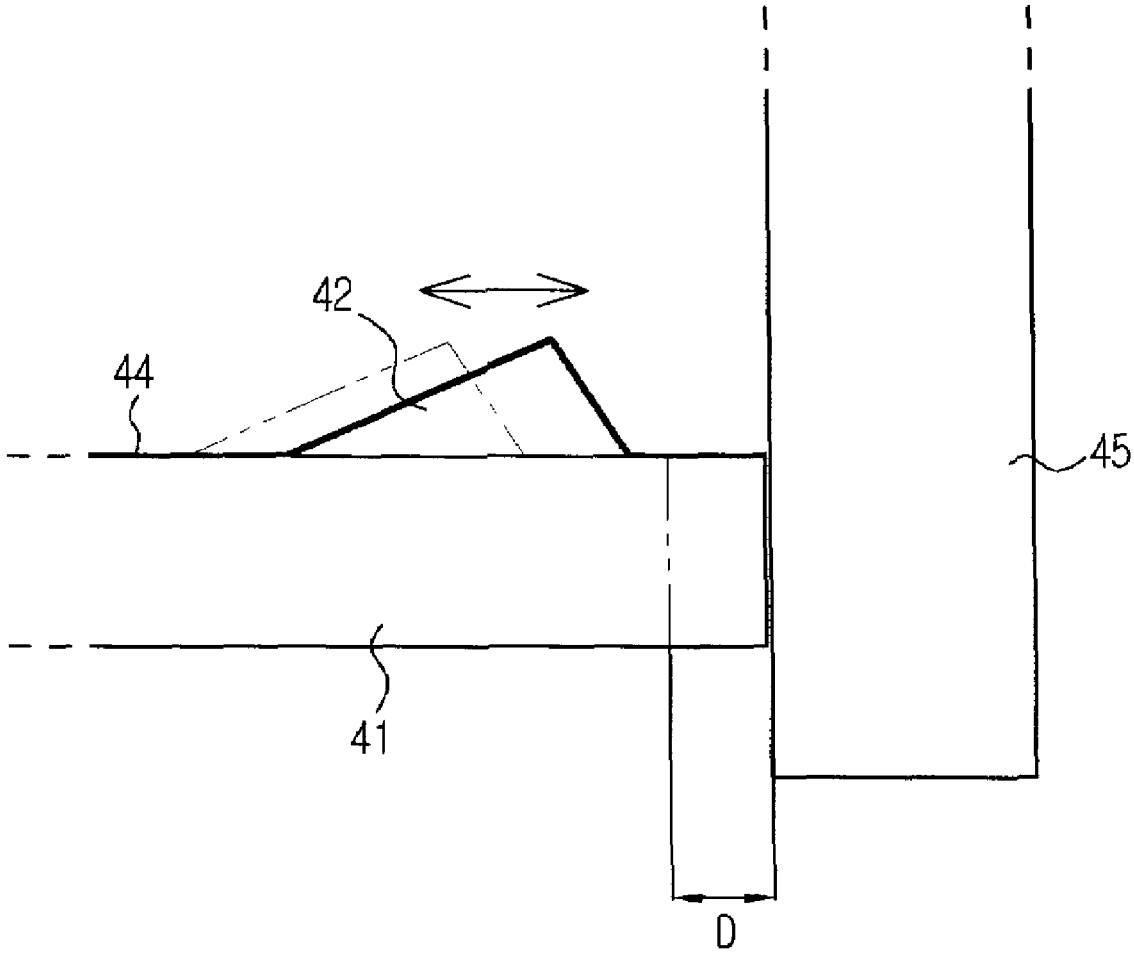

The collision member 45 is provided to enhance the conveyance of toner. As shown in FIG. 6, the collision member 45 is disposed in the downstream side from the conveying plate 41 on the toner conveying path, at a predetermined distance D from the end of the conveying plate 41. The distance D between the conveying plate 41 and the collision member 45 can vary depending on the vibration intensity of the vibration generating device 43, the distance between the vibration generating device 43 and the collision member 45 and the material of the conveying plate 41, however, the distance D may be preferably in the range of 0.1 mm to 1 mm. When the conveying plate 41 vibrates by the vibration generating device 43, the end of the conveying plate 41 collides with the collision member 45, reducing the velocity of the conveying plate 41. However the toner on the surface of the conveying plate 41 continue to move in the downstream direction by the inertial force. Accordingly, the toner conveying performance may be enhanced. The collision member 45 may be made of various materials which are not deformed by the collision, such as a metallic material, a ceramic material, a resin material or the like.

Figure 7A:
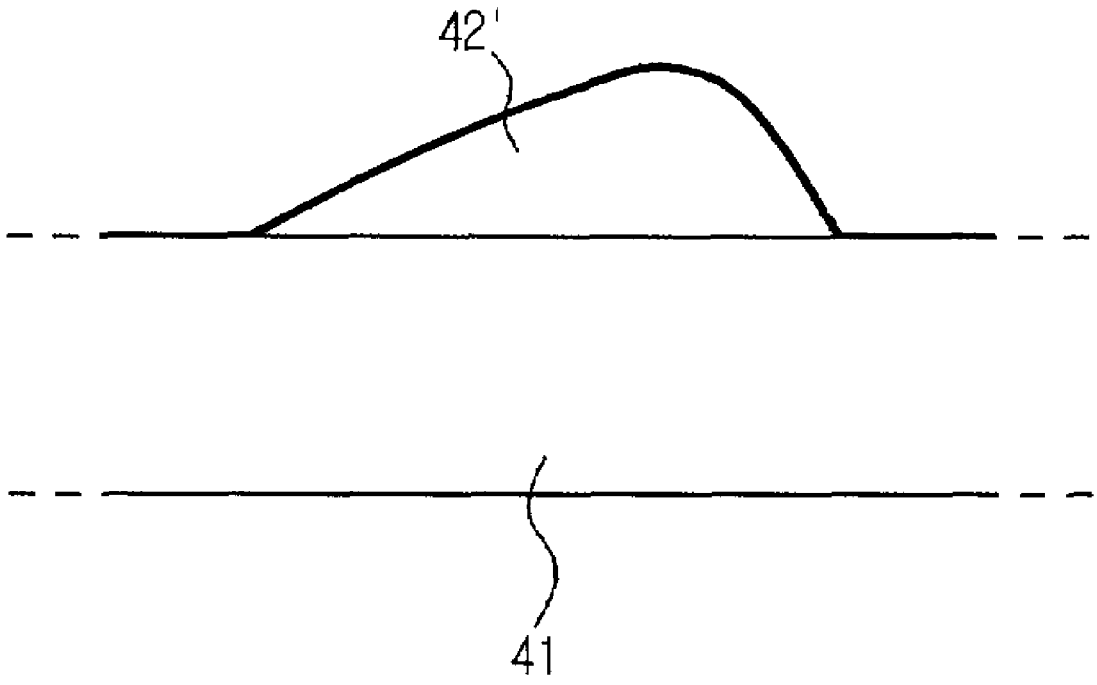
FIGS. 7*a* and 7*b* are side views illustrating several embodiments of the conveying protrusions of the powder conveying device.
Figure 7B:
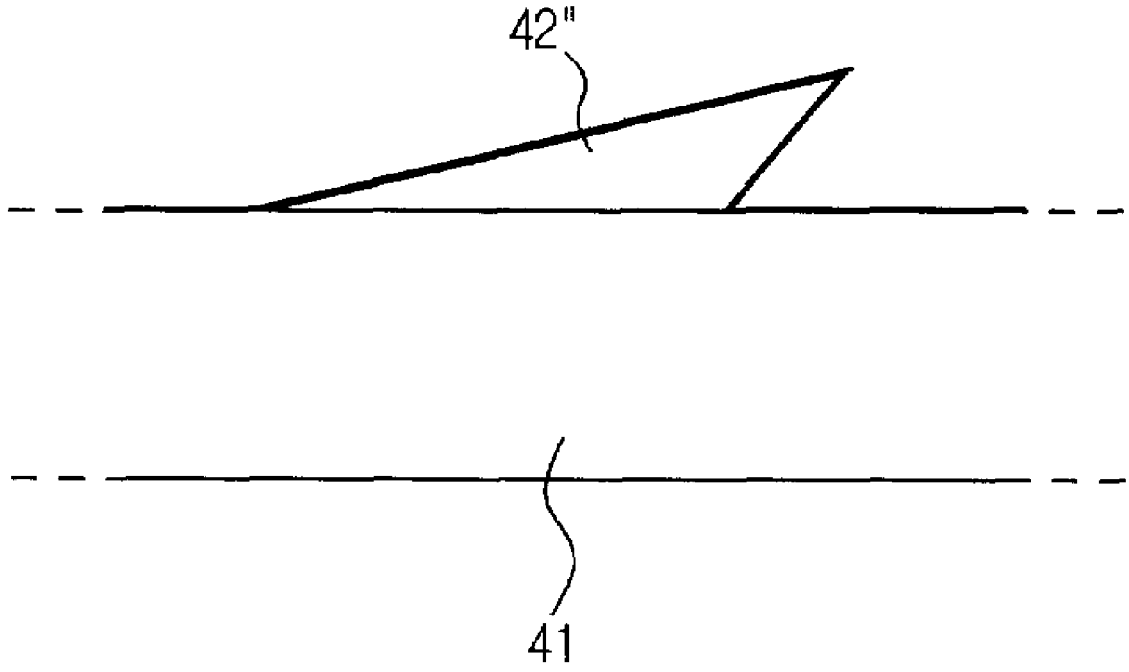

FIGS. 7*a* and 7*b* show examples of other embodiments of the conveying protrusions 42' and 42". Many other variations may be possible, including, as shown in FIG. 7A, curved ramp surfaces.

Figure 8:
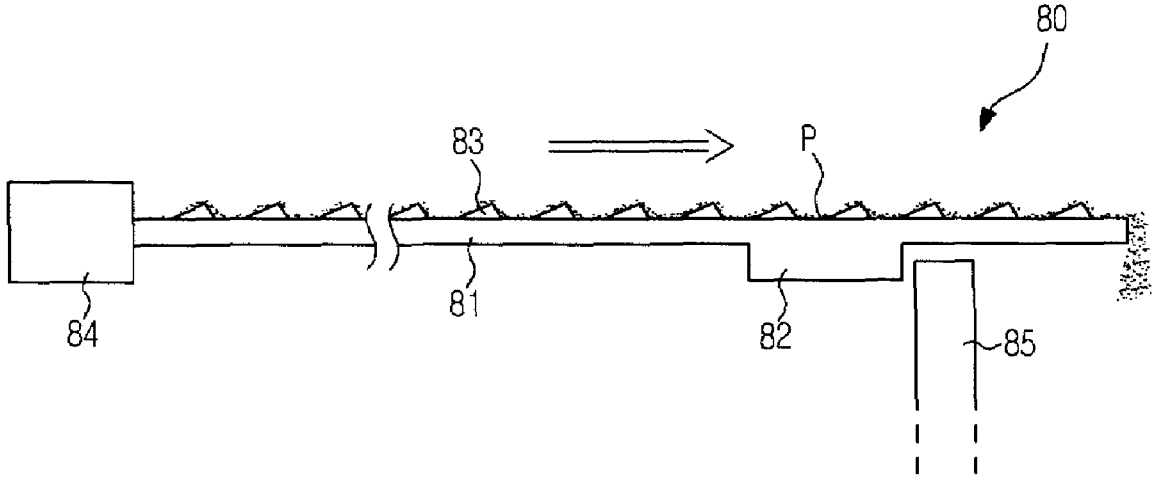
FIGS. 8 and 9 are side views schematically illustrating a powder conveying device according to yet another embodiment.
Figure 9:
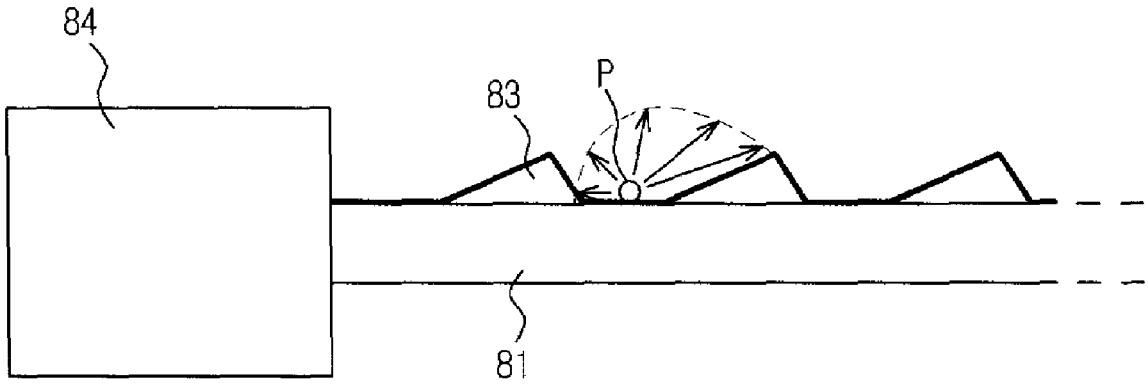

FIGS. 8 and 9 show schematically a powder conveying device according to another embodiment. Similarly to the powder conveying device 40 of the previous embodiment, a powder conveying device 80 shown in FIGS. 8 and 9 includes a conveying plate 81 and a plurality of conveying protrusions 83 arranged on the surface of the conveying plate 81. A vibration generating device 84 is mounted to the end in the upstream side of the conveying plate 41, and a collision member 85 is mounted below the conveying plate 81. The conveying plate 81 is provided with a collision portion 82 on the lower surface thereof. The collision portion 82 of the conveying plate 81 is disposed at a predetermined distance from the collision member 85, and collides with the collision member 85 when the conveying plate 81 vibrates. Since the collision member 85 is mounted below the conveying plate 81, the conveyed powder can be prevented from being attached to the end of the conveying plate 81 and the collision surface of the collision member 85.

As shown in FIG. 9, when the vibration generating device 84 is mounted at the upstream end of the conveying plate 81, the powder particles P on the surface of the conveying plate 81 can be applied with a larger propulsive force in the downstream direction, and thereby the powder conveyance may be enhanced.

Hereinafter, results of the experimental measurements of the conveyance performance of several proto-type powder conveying devices will be explained.

Embodiment 1-1

The conveying plate 41 of this embodiment is manufactured by the use of the photo-shaping method disclosed in Japanese Patent Laid-open Publication No. 2006-348214 (published on Dec. 28, 2006 to Katsuyuki et al.), the disclosure of which is incorporated herein by reference. The manufacturing steps are as follows.

First, dipentaerythritol hexaacrylate of 80 g, ethoxy trimethylolpropane triacrylate of 20 g, CGI403 of 3 g, 4-diethyl thioxanthone of 2 g, 4-dimethylaminobenzoate ethylester of 0.5 g, Yellow6G Gran of 2 g, SH28PA (manufactured by Ciba Specialty Chemicals Corporation of Basel, Switzerland) of 0.06 g, FM0411-TH (manufactured by Chiba Specialty Chemicals Corporation) of 0.18 g, and allyl ether copolymer (Mariarim AAB-0851: manufactured by Nippon Oils and Fats Co., Ltd. of Tokyo, Japan) of 6.5 g are added into a container having a mixing device, and are mixed at a temperature of 60° C. for 1 hour. Subsequently, alumina particles (TM-DAR: manufactured by Daimei Chemical Industry Co., Ltd. of Japan) of 209 g is added, and then is evenly dispersed by the use of a homogenizer (trade name "T. K. HOMODISPER™", manufactured by Tokushu Kika Kogyo Co., Ltd or Special Machine Industry Co., Ltd. both of Japan), thereby manufacturing a photo-curable liquid composition.

Thereafter, so manufactured photo-curable liquid composition is positioned on a stage which is moves up and down in the container, forming a thin layer of the liquid composition. The mask and the stage are selectively exposed to light to thereby forming the conveying plate 41. The plurality of conveying protrusions 42 are arranged with a predetermined gap therebetween on the surface of the conveying plate 41.

In this embodiment, the conveying plate 41 has a length of 100 mm, a width of 20 mm, and a thickness of 2 mm. Each of the conveying protrusions 42 has a height H of 0.03 mm, an upstream angle α of 5°, and a downstream angle β of 90°. The conveying protrusions 42 are arranged with a gap of 0.5 mm therebetween.

A flat motor (FM88E: manufactured by Tokyo Part Industry Co., Ltd. of Japan) is used as the vibration generating device 43, and is adhered to the upstream end of the conveying plate 41 by use of a double-sided adhesive tape with a thickness of 0.1 mm.

Embodiment 1-2

The powder conveying device of this embodiment has the same structure as the powder conveying device of the embodiment 1-1, except that the upstream angle α of the conveying protrusion 42 is 10°.

Embodiment 1-3

The powder conveying device of this embodiment has the same structure as the powder conveying device of the embodiment 1-1, except that the upstream angle α of the conveying protrusion 42 is 15°.

Embodiment 1-4

The powder conveying device of this embodiment has the same structure as the powder conveying device of the embodiment 1-1, except that the upstream angle α of the conveying protrusion 42 is 30°.

After placing 0.1 g of the powder on the upstream end of the conveying plate 41 of each of the powder conveying devices of the four aforementioned embodiments, a time required for the powder to be conveyed to the downstream of the conveying plate 41 was measured. The measured results are shown in the below table 1.

The powder used in the test was formed in such a way that the particles made of polyester resin, a staining agent and wax was externally treated with silica and titanium dioxide. The powder has a volume average diameter of 8.3 μm, a density of 0.44 g/cm$^3$, and an average sphericity of 0.912.

TABLE 1

| | Embodiment 1-1 | Embodiment 1-2 | Embodiment 1-3 | Embodiment 1-4 |
|---|---|---|---|---|
| Conveying Time (Sec) | 10 | 15 | 30 | Not Conveyed |

As can be seen from the above table 1, when the upstream angle α is smaller, the conveyance performance may be better.

Embodiment 2

The powder conveying device 40 of this embodiment has the same structure as the powder conveying device of the embodiment 1-1, except that the height H of the conveying protrusion 42 is 0.1 mm and the gap between the adjacent conveying protrusions is 1.5 mm. The powder conveying test was performed with respect to the powder conveying device of this embodiment under the same conditions as the aforementioned test. However, the powder could not be conveyed from the upstream end to the downstream end.

Embodiment 3

The powder conveying device 40 of this embodiment has the same structure as the powder conveying device of the embodiment 1-1, except that the vibration generating device 43 is mounted under the middle portion of the conveying plate 41. The powder conveying test was performed with respect to the powder conveying device of this embodiment under the same conditions as the aforementioned test. It took 25 seconds for the powder to be conveyed from the upstream end of the conveying plate to the downstream.

While in the above description various embodiments of powder conveying devices are described mainly in connection with their utility in supplying toner in developing units of image forming apparatuses, it should be readily apparent however that the powder conveying devices described herein have wider utilities. For example, powder conveying devices described herein can also be used to convey waste toner in an image forming apparatus, or can be used in any apparatuses, including manufacturing equipment, that requires conveyance of powder type material.

To that end, the powder conveying devices described herein may provide the advantages of taking up less space and/or of lower cost when compared with the conventional auger type, coil spring type or belt conveyor type powder conveying device.

Although embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A powder conveying device to convey powder, comprising:

a conveying plate having a surface on which the powder to be conveyed is supported;

a vibration generating device configured to cause the conveying plate to vibrate; and a plurality of conveying protrusions provided on the surface of the conveying plate to promote a movement of the powder from an upstream end of the conveying plate to a downstream end of the conveying plate;

a supply port disposed at the downstream end of the conveying plate to convey the powder to a supply roller disposed adjacent to the downstream end of the conveying plate that receives the powder and that delivers the powder to a developing member disposed adjacent to the supply roller that applies the powder received from the supply roller to an electrostatic latent image formed on a photosensitive body, wherein each of the plurality of conveying protrusions has a first inclined surface facing the upstream end of the conveying plate and a second inclined surface facing the downstream end of the conveying plate, each first inclined surface of an associated one of the plurality of conveying protrusions having a smaller incline angle than the second inclined surface of the associated one of the plurality of conveying protrusions.

2. The powder conveying device according to claim 1, wherein each of the conveying protrusions has a height less than or equal to ten times of a volume average diameter of particles of the powder.

3. The powder conveying device according to claim 2, wherein each of the conveying protrusions has a height less than or equal to five times of the volume average diameter of particles of the powder.

4. The powder conveying device according to claim 1, wherein each of the conveying protrusions is formed integrally with the conveying plate.

5. The powder conveying device according to claim 1, wherein the vibration generating device is mounted at the upstream end of the conveying plate.

6. The powder conveying device according to claim 1, wherein the vibration generating device comprises a flat vibration brushless motor.

7. The powder conveying device according to claim 1, wherein the first inclined surface forms a first angle with respect to the surface of the conveying plate, the second inclined surface forming a second angle with respect to the surface of the conveying plate, the first angle being between 1° to 20°, and the second angle being between 20° to 150°.

8. The powder conveying device according to claim 7, wherein the first angle is between angle of 10° to 15°.

9. The powder conveying device according to claim 1, further comprising:

a collision member disposed at a location within a range of motion of the conveying plate such that, when the conveying plate vibrates, the conveying plate collides with the collision member.

10. The powder conveying device according to claim 9, wherein the collision member is disposed near the downstream end of the conveying plate.

11. The powder conveying device according to claim 1, wherein the conveying plate and the plurality of conveying protrusions are coated with a coating layer to prevent the powder from adhering to surfaces of at least one of the conveying plate and the plurality of conveying protrusions.

12. The powder conveying device according to claim 1, wherein the vibration generating device has a vibration intensity between 1 G to 11 G and a number of revolution between 1,000 to 100,000 revolution per minute.

13. An image forming apparatus comprising:

a main body defining an exterior appearance of the image forming apparatus; and a toner conveying device disposed in the main body, wherein the toner conveying device comprises:

a conveying plate having a surface on which toner to be conveyed is supported;

a vibration generating device configured to cause the conveying plate to vibrate;

and a plurality of conveying protrusions provided on the surface of the conveying plate to promote a movement of the toner from an upstream end of the conveying plate to a downstream end of the conveying plate; and a developing unit disposed in the main body, the developing unit including:

a supply roller disposed adjacent to the downstream end of the conveying plate so as to receive toner from the toner conveying device; and a developing member disposed adjacent to the supply roller to receive the toner from the supply roller and to apply the toner received from the supply roller to an electrostatic latent image formed on a photosensitive body, wherein each of the plurality of conveying protrusions has a first inclined surface facing the upstream end of the conveying plate and a second inclined surface facing the downstream end of the conveying plate, each first inclined surface of an associated one of the plurality of conveying protrusions having a smaller incline angle than the second inclined surface of the associated one of the plurality of conveying protrusions.

14. The image forming apparatus according to claim 13, wherein each of the conveying protrusions has a height less than or equal to ten times of a volume average diameter of particles of the toner.

15. The image forming apparatus according to claim 13, wherein each of the conveying protrusions is formed integrally with the conveying plate.

16. The image forming apparatus according to claim 13, wherein the vibration generating device is mounted at the upstream end of the conveying plate.

17. The image forming apparatus according to claim 13, wherein the vibration generating device comprises a flat vibration brushless motor.

18. The image forming apparatus according to claim 13, wherein the first inclined surface forms a first angle with respect to the surface of the conveying plate, the second inclined surface forming a second angle with respect to the surface of the conveying plate, the first angle being between 1° to 20°, and the second angle being between 20° to 150°.

19. The image forming apparatus according to claim 10, wherein the toner conveying device further comprises:

a collision member disposed at a location within a range of motion of the conveying plate such that, when the conveying plate vibrates, the conveying plate collides with the collision member.

20. The image forming apparatus according to claim 19, wherein the collision member is disposed near the downstream end of the conveying plate.

21. The image forming apparatus according to claim 13, wherein the conveying plate and the plurality of conveying protrusions are coated with a coating layer to prevent the toner from adhering to surfaces of at least one of the conveying plate and the plurality of conveying protrusions.

22. The image forming apparatus according to claim 13, wherein the vibration generating device has a vibration intensity between 1 G to 11 G and a number of revolution between 1,000 to 100,000 revolution per minute.

* * * * *